US008496310B2

(12) United States Patent
Tamada et al.

(10) Patent No.: US 8,496,310 B2
(45) Date of Patent: Jul. 30, 2013

(54) RECORDING APPARATUS

(75) Inventors: Hisashi Tamada, Nagoya (JP); Keiji Kura, Nagoya (JP); Yusuke Suzuki, Aichi-ken (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 240 days.

(21) Appl. No.: 13/039,629

(22) Filed: Mar. 3, 2011

(65) Prior Publication Data

US 2011/0242160 A1 Oct. 6, 2011

(30) Foreign Application Priority Data

Mar. 30, 2010 (JP) ..... 2010-076645

(51) Int. Cl.
*B41J 29/38* (2006.01)
*B41J 29/393* (2006.01)

(52) U.S. Cl.
USPC ..... 347/9; 347/19

(58) Field of Classification Search
CPC ..... B41J 2/2135
USPC ..... 347/9–11, 19, 23
See application file for complete search history.

(56) References Cited

U.S. PATENT DOCUMENTS 6,736,482 B1 * 5/2004 Suzuki ..... 347/23
7,524,013 B2 * 4/2009 Inoue ..... 347/19
8,007,070 B2 * 8/2011 Kaga et al. ..... 347/23
2003/0184608 A1 10/2003 Masuyama et al.
2008/0238074 A1 10/2008 Marriott et al.

FOREIGN PATENT DOCUMENTS

| | | |
|---|---|---|
| JP | 3187762 | 8/1991 |
| JP | 2001105613 | 4/2001 |
| JP | 2001-180010 | 7/2001 |
| JP | 2004001416 | 1/2004 |
| JP | 2005-096281 | 4/2005 |
| JP | 2006-168074 | 6/2006 |
| JP | 2006-334984 | 12/2006 |
| JP | 2008-246810 | 10/2008 |

OTHER PUBLICATIONS

Notice of Reasons for Rejection of Japanese Patent Application No. 2010-076645 dated Jul. 31, 2012.
Notice of Reasons for Rejection of Japanese Patent Application No. 2010-076645 dated Jan. 8, 2013.

* cited by examiner

*Primary Examiner* — An Do
(74) *Attorney, Agent, or Firm* — Frommer Lawrence & Haug LLP

(57) ABSTRACT

There is provided a recording apparatus including: a head jetting liquid droplets from nozzles; and a controller controlling the head to perform a recording jetting-operation for jetting the liquid droplets toward a recording medium from the nozzles at each of drive periods, and a flushing operation for performing maintenance on the nozzles by jetting the liquid droplets from the nozzles prior to the recording jetting-operation. The controller controls the head so that with respect to each of the nozzles, a total liquid discharge amount in the flushing operation becomes less in a case of jetting a liquid droplet at a first drive period in the recording jetting-operation, in comparison with a case of not jetting the liquid droplet at the first drive period.

7 Claims, 5 Drawing Sheets

RECORDING APPARATUS

CROSS REFERENCE TO RELATED APPLICATION

The present application claims priority from Japanese Patent Application No. 2010-07664, filed on Mar. 30, 2010, the disclosure of which is incorporated herein by reference in its entirety.

BACKGROUND OF THE INVENTION

1. Field of the Invention

The present invention relates to a recording apparatus which performs recording by jetting droplets of liquid such as ink droplets from nozzles.

2. Description of the Related Art

In the known ink-jet recording apparatus, a plurality of nozzles formed in the ink-jet head are divided into four nozzle groups to align in the transport direction of a recording medium. During printing, ink droplets are jetted from the nozzles included in the nozzle groups to areas of the recording medium facing the nozzle groups, respectively, to perform a high-quality printing. Further, at the time right before the ink droplets are initially jetted from the nozzles forming nozzle groups, a preliminary discharge (flushing operation) is performed to maintain the nozzles by discharging thickened ink from the nozzles so as to keep a preferable state for the nozzles to jet the ink.

However, in the above described ink-jet recording apparatus, it is necessary to jet a considerably large amount of ink from the nozzles in the flushing operation in order to perform maintenance on the nozzles only by means of the flushing operation performed right before printing. As a result, non-printing ink consumption has to be increased.

SUMMARY OF THE INVENTION

Accordingly, an object of the present invention is to provide a recording apparatus capable of performing maintenance on the nozzles while restraining the non-printing ink consumption as much as possible.

According to an aspect of the present invention, there is provided a recording apparatus which jets droplets of a liquid onto a recording medium to perform printing, including:

a head which jets the liquid droplets and in which a plurality of nozzles are formed; and a controller which controls the head to perform a recording jetting-operation in which the liquid droplets are jetted toward the recording medium from the nozzles at a plurality of drive periods, respectively, based on input data input to the recording apparatus and a flushing operation in which a maintenance on the nozzles is performed by jetting the liquid droplets from the nozzles prior to the recording jetting-operation, wherein the controller judges, based on the input data, whether or not the head jets a liquid droplet from each of the nozzles at a first drive period of the drive periods in the recording jetting-operation, and controls the head so that a total liquid discharge amount in each of the nozzles in the flushing operation becomes less in a case of jetting a liquid droplet at the first drive period, in comparison with a case of not jetting the liquid droplet at the first drive period.

In the recording apparatus according to the present invention, the head is controlled so that when a liquid droplet is jetted at the first drive period of the recording jetting-operation that is performed just after the flushing operation, the total liquid discharge amount in each of the nozzles in the flushing operation become less in comparison with the case of not jetting the liquid droplets at the first drive period. By virtue of this, in addition to the liquid droplets jetted in the flushing operation, the recording jetting-operation is collaboratively performed to maintain the nozzles by jetting the liquid droplets at the first drive period for recording. That is, the head jets the liquid droplets in the flushing operation, and successively jets the liquid droplets after the flushing operation when the liquid droplets are jetted at the first drive period in the recording jetting-operation. Therefore, even when the maintenance on the nozzles in the recording jetting-operation is insufficient, the head is still able to jet the liquid droplets, although these liquid droplets may be incomplete for the recording jetting-operation. On the other hand, when the liquid droplets are not jetted at the first drive period in the recording jetting-operation, there is a substantial time interval in which the liquid droplets are not jetted until the recording jetting-operation is performed after the flushing operation is finished. In this case, when the maintenance on the nozzles in the recording jetting-operation is insufficient, there is a fear that the liquid droplets cannot be normally jetted in the succeeding recording jetting-operation because of the substantial time interval in which the liquid droplets are not jetted. Therefore, it is possible to perform maintenance on the nozzles while reducing the liquid consumption, with respect to the nozzles through which the liquid droplets are jetted at the first drive period in the recording jetting-operation.

According to the present teaching, when a liquid droplet is jetted at the first drive period of the recording jetting-operation that is performed just after the flushing operation, the total liquid discharge amount, of each of the nozzles, in the flushing operation becomes less in comparison with the case of not jetting the liquid droplets at the first drive period. By virtue of this, it is possible to perform the maintenance on the nozzles not only by jetting the liquid droplets in the flushing operation but also by jetting the liquid droplets at the first drive period for recording. Thereby, it is possible to perform the maintenance on the nozzles while reducing the liquid consumption.

DESCRIPTION OF THE PREFERRED EMBODIMENT

Hereinbelow, explanations will be made with respect to a preferred embodiment of the present teaching.

Figure 1:
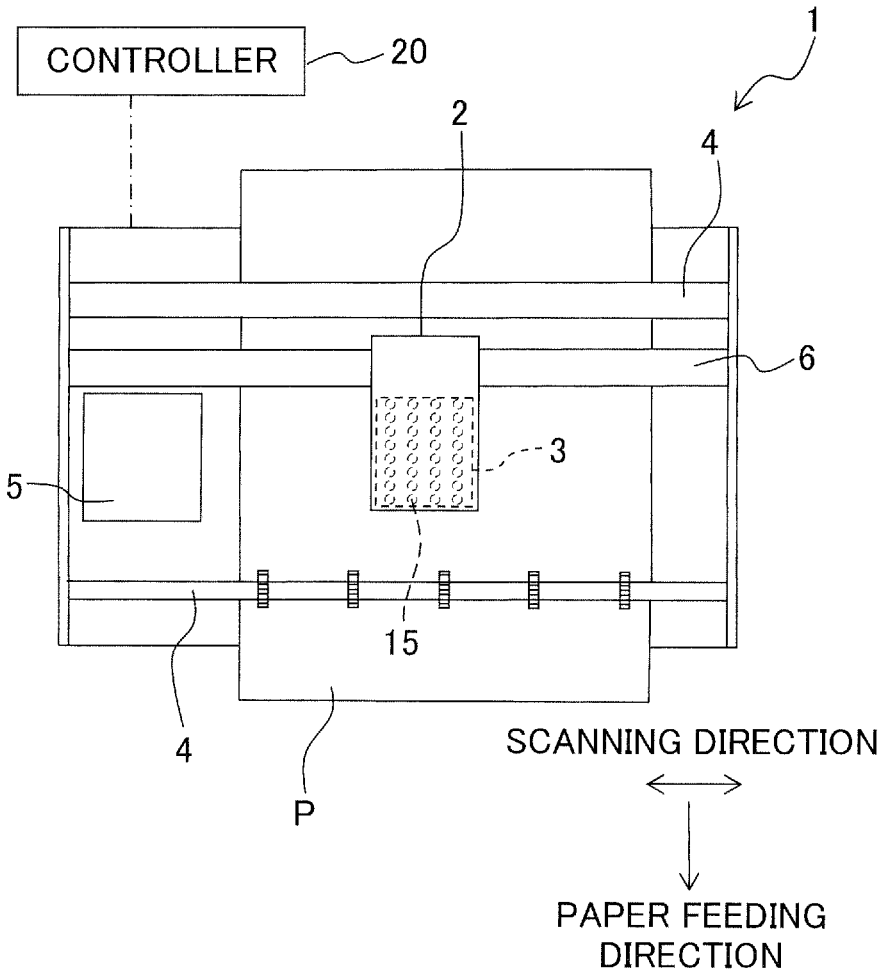
FIG. 1 is a schematic configuration diagram of a printer as an example of the recording apparatus in accordance with an embodiment of the present invention.

As shown in FIG. 1, a printer 1 (recording apparatus) includes a carriage 2, an ink-jet head 3, paper transport rollers 4, a foam for waste liquid 5, and the like. Further, a controller 20 controls the operation of the printer 1.

The carriage 2 is guided by a guide shaft 6 to move reciprocatingly in a scanning direction (a left-right direction of FIG. 1). The ink-jet head 3 is arranged on the lower surface of the carriage 2 to jet ink droplets from a plurality of nozzles 15 formed in the lower surface of the ink-jet head 3. The paper transport rollers 4 transport a recording paper P (a recording medium) in a paper feeding direction perpendicular to the scanning direction (a downward direction of FIG. 1).

Then, the printer 1 performs printing on the recording paper P by jetting ink droplets during each of the predetermined drive periods from the ink-jet head 3, which is mounted on the carriage 2 and reciprocates in the scanning direction, onto the recording paper P transported by the paper transport rollers 4 in the paper feeding direction. Further, during printing, the operation, in which the ink droplets are jetted from the ink-jet head 3 during each of the predetermined drive periods, corresponds to a recording jetting-operation in accordance with the present teaching.

The foam for waste liquid 5 is arranged so that when the carriage 2 moves to the left side of FIG. 1 approximately to the maximum extent, the foam for waste liquid 5 faces the plurality of nozzles 15. Then, as will be described hereinafter, just before or in the middle of a print operation, the controller 20 controls the ink jet-head 3 to jet the ink droplets that are same as those jetted in printing from the plurality of nozzles 15, when the carriage 2 is moved to this position. By virtue of this, it is possible to perform a flushing operation in which the thickened ink is discharged from the nozzles 15 to maintain the nozzles 15. At the time, the ink jet head 3 performs the flushing operation by jetting the same ink droplets as those jetted in printing. Therefore, the ink-jet head 3 is configured to perform a flushing operation through a same operation that is performed in a recording jetting-operation.

Next, explanations will be made with respect to the controller 20 which performs the control of the printer 1.

Figure 2:
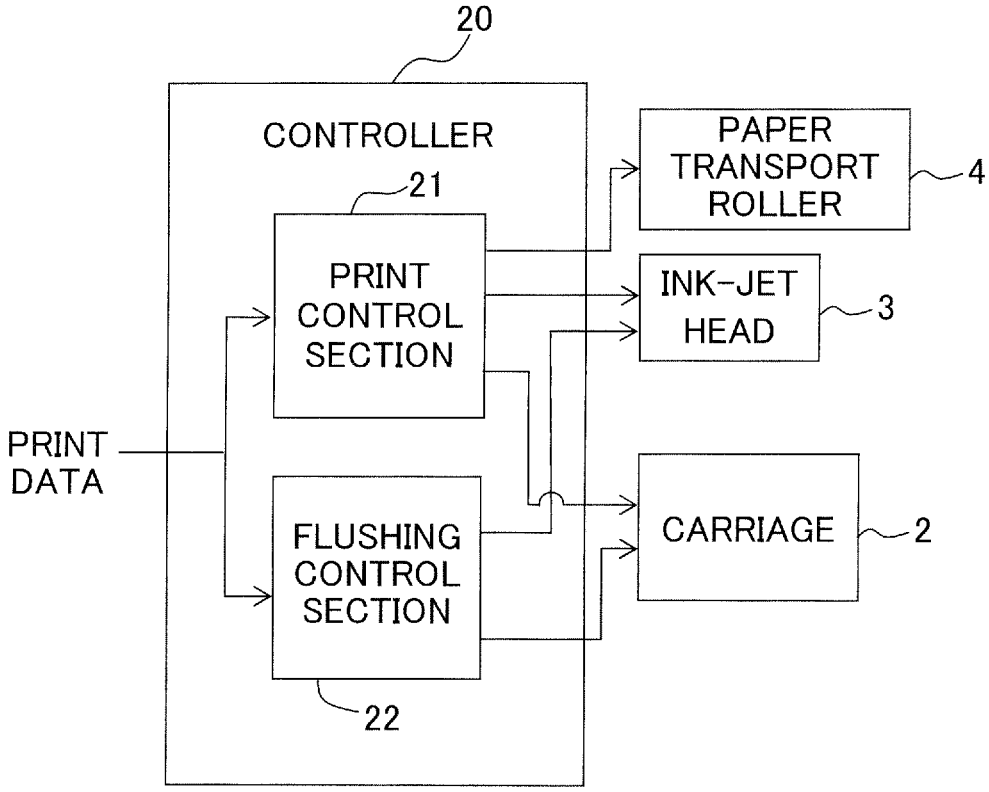
FIG. 2 is a functional block diagram of a controller of the printer of FIG. 1.

The controller 20 includes a Central Processing Unit (CPU), a Read Only Memory (ROM), a Random Access Memory (RAM), and the like. As shown in FIG. 2, the controller 20 functions as a print control section 21 and a flushing control section 22.

The print control section 21 controls the operations of the carriage 2, the ink-jet head 3 and the paper transport rollers 4 in the print operation, based on a print data inputted from outside of the printer 1. The flushing control section 22 controls the operations of the carriage 2 and the ink-jet head 3 in the flushing operation as will be described hereinafter, based on the inputted print data.

Figure 3:
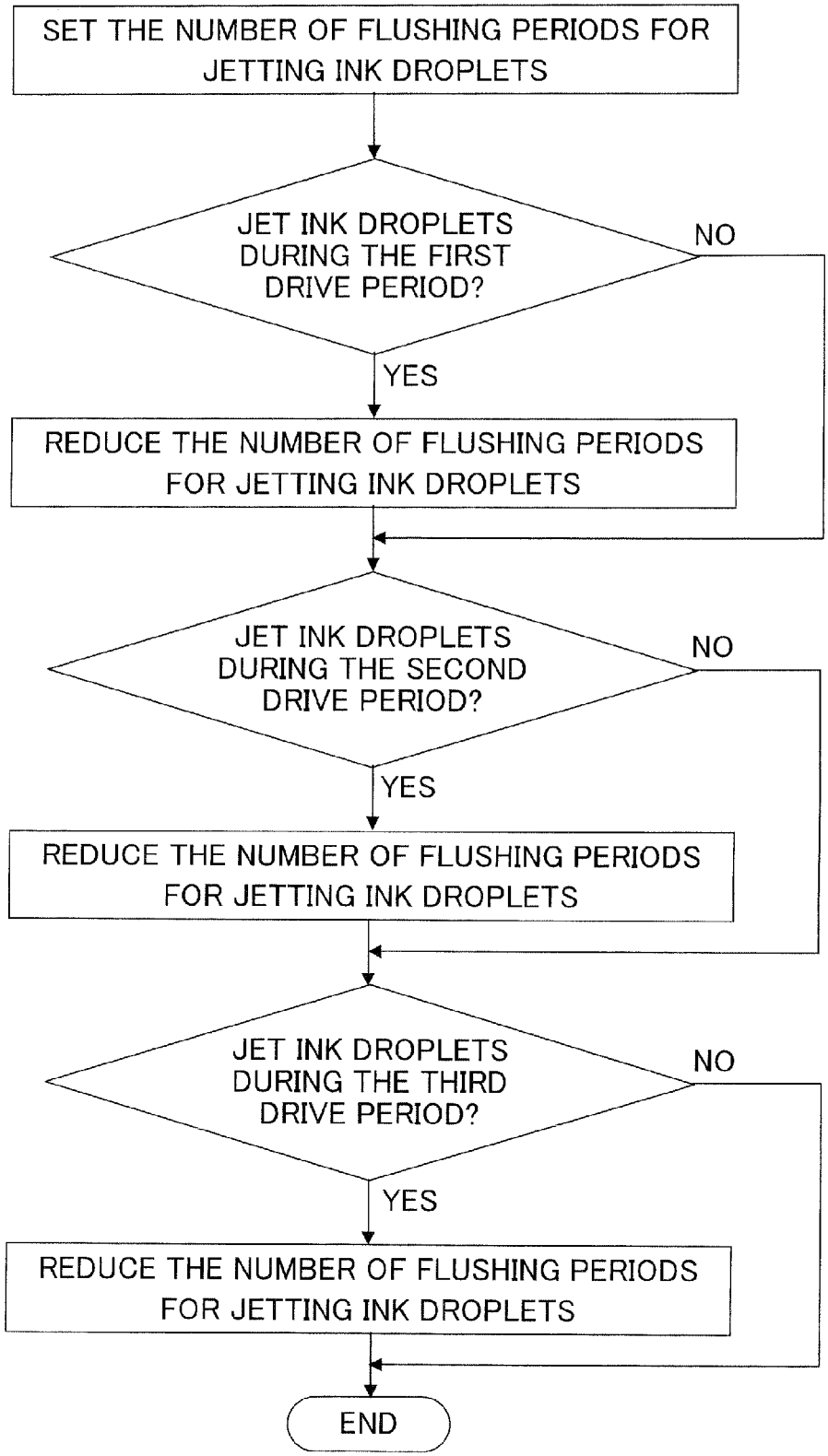
FIG. 3 is a flowchart for explaining the examples 1a to 1f of the present invention.

Next, explanations will be made with respect to the flushing operation performed just before the print operation (a recording jetting-operation) in the printer 1 (see the flowchart as shown in FIG. 3). Tables 1A to 1C show jetting aspects of ink droplets during the first three drive periods of the recording jetting-operation and the flushing operation that is performed just before the recording jetting-operation, in the examples 1a to 1f in which the flushing operation is performed just before the print operation. Further, in the tables 1A to 1C, table 2A to 2C, and a table 3 which will be described hereinafter, an "o" indicates that ink droplets are jetted, whereas a "-" indicates that ink droplets are not jetted.

TABLE 1A

| | Flushing Period | | | | | Drive Period | | |
|---|---|---|---|---|---|---|---|---|
| | 1 | 2 | 3 | 4 | 5 | 1 | 2 | 3 |
| Example 1a | — | — | — | o | o | o | o | o |
| Example 1d | — | — | o | o | o | — | o | o |

TABLE 1B

| | Flushing Period | | | | | Drive Period | | |
|---|---|---|---|---|---|---|---|---|
| | 1 | 2 | 3 | 4 | 5 | 1 | 2 | 3 |
| Example 1b | — | — | o | o | o | o | — | o |
| Example 1e | — | o | o | o | o | — | — | o |

TABLE 1C

| | Flushing Period | | | | | Drive Period | | |
|---|---|---|---|---|---|---|---|---|
| | 1 | 2 | 3 | 4 | 5 | 1 | 2 | 3 |
| Example 1c | — | o | o | o | o | o | — | — |
| Example 1f | o | o | o | o | o | — | — | — |

As shown in the tables 1A to 1C, in the embodiment, the controller 20 controls the ink-jet head 3 to perform the flushing operation so that the ink droplets are jetted from the nozzles 15 during the successive five flushing periods. Then, the ink amount discharged during all of the five flushing periods is adjusted so that it is sufficient to perform the maintenance on the nozzles 15, regardless of the conditions such as the time interval in which printing is not performed before the flushing operation. Further, the ink amount which is sufficient to perform the maintenance on the nozzles 15 means an ink amount which is sufficient to discharge the thickened ink from the nozzles 15 to normalize the jetting performance of the nozzles 15 after the flushing operation.

Therefore, when the controller 20 controls the flushing operation so that the ink droplets are uniformly jetted from the nozzles 15 during all of the above five flushing periods before performing a print operation, then the maintenance is sufficiently performed on the nozzles 15. However, when the maintenance is sufficiently performed on the nozzles 15 only by the flushing operation in this manner, it may result in increased ink consumption.

As shown in the tables 1A to 1C, comparisons are made between the examples 1a and 1d, between the examples 1b and 1e, and between the examples 1c and 1f, respectively. In the embodiment, the controller 20 controls the ink-jet head 3 so that when the ink droplets are jetted from the nozzles 15 at the first drive period of the recording jetting-operation, the number of the flushing periods for jetting ink droplets in the five flushing periods is reduced in comparison with the case of not jetting ink droplets at the first drive period. Further, the number of the flushing periods for jetting ink droplets corresponds to the total ink discharge amount in the flushing operation. Here, the maintenance is performed on the nozzles 15 not only by jetting ink droplets in the flushing operation but also by jetting ink droplets during the first drive period for printing. In the flushing operation, ink droplets are jetted from the nozzles 15, in the same manner as in the recording jetting-operation. In the case of jetting ink droplets during the first drive period of the recording jetting-operation, ink droplets are jetted successively after the flushing operation. Therefore, even when the maintenance on the nozzles 15 is incomplete in the flushing operation, the (incomplete) ink droplets are jetted in the recording jetting-operation. On the other hand, in the case of not jetting ink droplets at the first drive period of the recording jetting-operation, after the flushing operation is finished, there is a longer time interval in which ink droplets are not jetted until the recording jetting-operation is performed. Therefore, when an incomplete maintenance is performed on the nozzles 15 in the flushing operation, there is a fear that ink droplets cannot be jetted normally in the succeeding recording jetting-operation because of this time interval in which ink droplets are not jetted. Therefore, in the nozzles 15 through which the ink droplets are jetted at the first drive period of the recording jetting-operation, the maintenance on the nozzles 15 is also performed by jetting ink droplets at the first drive period for printing. Thereby, it is possible to perform the maintenance on the nozzles 15 while reducing the ink consumption in the flushing operation. In this case, even though incomplete ink droplets are jetted at the first drive period, after that, the nozzles 15 gradually come close to the complete state every time ink droplets are jetted. Therefore, even when incomplete ink droplets are jetted at the first drive period, no conspicuous quality deterioration may occur in the image recorded on the recording paper P.

Further, as is understood from the comparisons between the examples 1a to 1c of the tables 1A to 1C, and between the examples 1d to 1f of the tables 1A to 1C, in the embodiment, the controller 20 controls the ink-jet head 3 so that the total ink discharge amount in the flushing operation becomes less for the case of a larger total amount of ink droplets jetted during the three successive drive periods including the first drive period, when the jetting aspects of the ink droplets are the same at the first drive period.

Then, by virtue of this, with respect to each of the nozzles 15, the total ink amount in which the ink discharge amount discharged in the flushing operation and the amount of ink droplets jetted during the above three drive periods are summed is equal to the ink amount to be discharged in the case of jetting ink droplets during all of the five flushing periods in the flushing operation. Such total ink amount corresponds to the maximum ink amount dischargeable in the flushing operation. Hereinbelow, this ink amount will be referred to as the maximum flushing amount.

In the case of jetting ink droplets during the above three drive periods, the maintenance on the nozzles 15 is performed not only by jetting ink droplets in the flushing operation but also by jetting ink droplets during the above three drive periods for printing, in the same manner as described hereinabove. Further, in this case, when a larger total amount of ink droplets is jetted during the three drive periods, the ink droplet jetted during those drive periods makes a greater contribution to the maintenance on the nozzles 15. Therefore, it is possible to lessen the total ink discharge amount in the flushing operation, with increasing the total amount of ink droplets jetted during the above three drive periods. By virtue of this, it is possible to further reduce the ink consumption.

Further, the total ink amount of summing up the total ink discharge amount in the flushing operation and the total amount of ink droplets jetted during the above three drive periods becomes the same as the maximum flushing amount. Therefore, regardless of the jetting aspects of the ink droplets during the three drive periods (for example, whether or not the ink droplets are jetted or how many times the ink droplets are jetted during the three drive periods), a sufficient amount of ink is jetted for performing the maintenance on the nozzles 15 before the above three drive periods elapse. Further, because ink droplets of more than the maximum flushing amount are not to be jetted before the above three drive periods elapse, it is also possible to restrain the ink consumption at a minimum level.

In the above example, the flushing operation is performed with five periods. However, the present teaching is not limited to this. For example, as shown in the tables 2A to 2C, the flushing operation can also be performed with seven periods. Further, because the examples 1a' to 1f' as shown in the tables 2A to 2C correspond respectively to the examples 1a to 1f as shown in the tables 1A to 1C except for the aspect that the flushing operation is performed with seven periods, detailed explanations will be omitted.

TABLE 2A

| | Flushing Period | | | | | | | Drive Period | | |
|---|---|---|---|---|---|---|---|---|---|---|
| | 1 | 2 | 3 | 4 | 5 | 6 | 7 | 1 | 2 | 3 |
| Example 1a' | — | — | — | ○ | ○ | ○ | ○ | ○ | ○ | ○ |
| Example 1d' | — | — | ○ | ○ | ○ | ○ | ○ | — | ○ | ○ |

TABLE 2B

| | Flushing Period | | | | | | | Drive Period | | |
|---|---|---|---|---|---|---|---|---|---|---|
| | 1 | 2 | 3 | 4 | 5 | 6 | 7 | 1 | 2 | 3 |
| Example 1b' | — | — | ○ | ○ | ○ | ○ | ○ | ○ | — | ○ |
| Example 1e' | — | ○ | ○ | ○ | ○ | ○ | ○ | — | — | ○ |

TABLE 2C

| | Flushing Period | | | | | | | Drive Period | | |
|---|---|---|---|---|---|---|---|---|---|---|
| | 1 | 2 | 3 | 4 | 5 | 6 | 7 | 1 | 2 | 3 |
| Example 1c' | — | ○ | ○ | ○ | ○ | ○ | ○ | ○ | — | — |
| Example 1f' | ○ | ○ | ○ | ○ | ○ | ○ | ○ | — | — | — |

Figure 4:
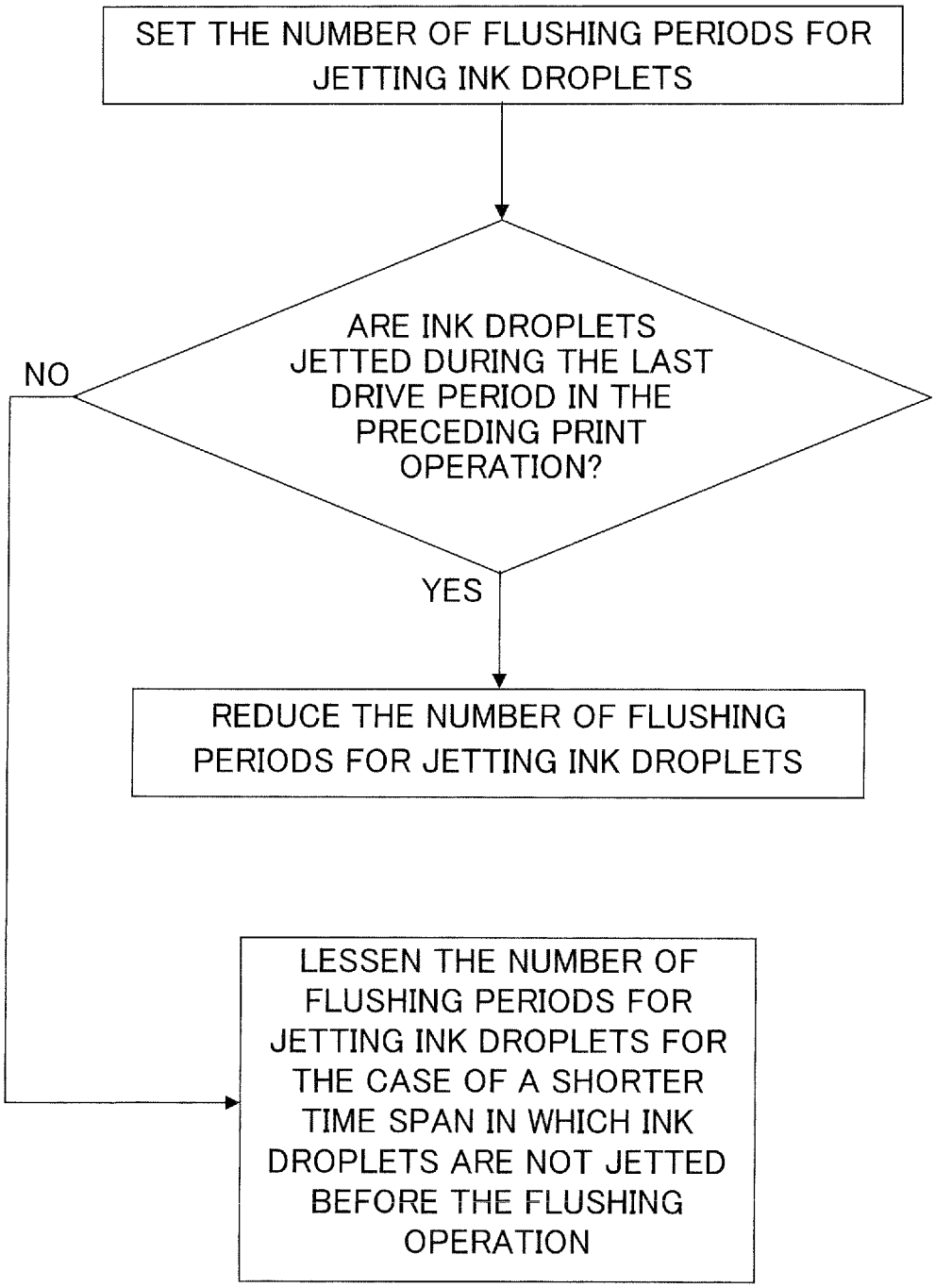
FIG. 4 is a flowchart for explaining the examples 2a to 2d of the present invention.

Next, explanations will be made with respect to a case in which the flushing operation is performed between two recording jetting-operations in the printing on a plurality of sheets of the recording paper P (see the flowchart as shown in FIG. 4). This corresponds to a case in which the flushing operation is performed in each time when the printing on a predetermined number of sheets of the recording papers P is finished, or a case in which the flushing operation is performed in each time when one movement in the scanning direction is completed during printing on one recording paper P, or a case in which the flushing operation is performed in each time when several movements in the scanning direction are completed during printing on one recording paper P.

When the flushing operation is performed between two recording jetting-operations, the jetting amount of the ink in the flushing operation can be varied in accordance with the jetting aspect of ink droplets during the last three successive drive periods of the recording jetting-operation performed just before the flushing operation (the preceding recording jetting-operation), and the jetting aspect of ink droplets during the first three successive drive periods of the recording jetting-operation performed just after the flushing operation (the succeeding recording jetting-operation).

Here, the relationship between the jetting aspect of the ink droplets during the first three successive drive periods of the succeeding recording jetting-operation and the total ink discharge amount in the flushing operation is the same as the above mentioned relationship between the jetting aspect of the ink droplets during the first three drive periods of the recording jetting-operation and the total ink discharge amount in the flushing operation just before the three drive periods. Here, detailed explanation with respect to the relationship between the jetting aspect of the ink droplets during the first three successive drive periods of the succeeding recording jetting-operation and the total ink discharge amount in the flushing operation is omitted, but explanations will be made with respect to the relationship between the jetting aspect of ink droplets during the last successive three drive periods of the preceding recording jetting-operation and the total ink discharge amount in the flushing operation.

The table 3 shows jetting aspects of ink droplets during the last three successive drive periods of the preceding recording jetting-operation (No. n, No. n−1, and No. n−2 drive periods), the five flushing periods of the flushing operation, and the first three successive drive periods of the succeeding recording jetting-operation, in the examples 2a to 2d in which the flushing operation is performed between two recording jetting-operations. Further, in the examples 2a to 2d of the table 3, the ink droplets are jetted only at the first drive period in the succeeding recording jetting-operation. That is, in the examples 2a to 2d, the jetting aspects of ink droplets are the same at the first drive period.

TABLE 3

| | Drive period of preceding recording jetting-operation | | | Flushing period | | | | | Drive period of succeeding recording jetting-operation | | |
|---|---|---|---|---|---|---|---|---|---|---|---|
| | n − 2 | n − 1 | n | 1 | 2 | 3 | 4 | 5 | 1 | 2 | 3 |
| Ex. 2a | — | — | ○ | — | — | — | — | ○ | ○ | — | — |
| Ex. 2b | — | ○ | — | — | — | — | ○ | ○ | ○ | — | — |
| Ex. 2c | ○ | — | — | — | — | ○ | ○ | ○ | ○ | — | — |
| Ex. 2d | — | — | — | — | ○ | ○ | ○ | ○ | ○ | — | — |

As is understood by comparing the Example 2a with the Examples 2b to 2d in the table 3, in the embodiment, the controller 20 controls the ink-jet head 3 so that when the ink droplets are jetted at the last (No. n) drive period in the preceding recording jetting-operation, the number of the flushing periods during which ink droplets are jetted (the ink discharge amount in the flushing operation) is reduced in comparison with the case of not jetting ink droplets at the last drive period in the preceding recording jetting-operation.

When the ink droplets are jetted at the last drive period in the preceding recording jetting-operation, the time interval before the maintenance on the nozzles 15, which is performed by jetting ink droplets in the flushing operation, becomes shorter. The longer the time interval in which ink droplets are not jetted from the nozzles 15 is, the more the ink viscosity increases. However, when the ink droplets are jetted at the last drive period in the preceding recording jetting-operation, the ink is thickening at a low degree before the flushing operation begins. Therefore, in such a case, because the controller 20 controls the ink-jet head 3 so that the total ink discharge amount decreases in the flushing operation, it is possible to perform the maintenance on the nozzles 15 while reducing the ink consumption.

Further, as is understood by comparing the examples 2b to 2d, the controller 20 controls the ink-jet head 3 so that when the ink droplets are not jetted at the last drive period in the preceding recording jetting-operation, the total ink discharge amount in the flushing operation may become less for the case of a shorter time interval in which ink droplets are not jetted before the flushing operation.

Even when the ink droplets are not jetted at the last drive period in the preceding recording jetting-operation, there may be a case in which the ink droplets are jetted during the prior drive periods. In such a case, the ink is less thickened, when the non-jetting time interval from the last jetting of ink droplets to the beginning of the flushing operation becomes shorter.

Therefore, when the ink droplets are not jetted at the last drive period in the preceding recording jetting-operation, the controller 20 controls the ink-jet head 30 so that the total ink discharge amount in the flushing operation become less for the case of a shorter time interval in which the ink droplets are not jetted. By virtue of this, it is possible to perform the maintenance on the nozzles 15 while reducing the ink consumption.

Next, explanations will be made with respect to a few modifications which apply various changes to the embodiment. However, it should be appreciated that the constitutive parts or components, which are the same as or equivalent to those of the embodiment, are designated by the same reference numerals, any explanation of which will be omitted as appropriate.

Further, in the embodiment, the total ink discharge amount in the flushing operation is determined not only by whether or not the ink droplets are jetted at the first drive period but also by the total amount of ink droplets jetted during the first three successive drive periods. However, the present teaching is not limited to such aspect. For example, the total ink discharge amount in the flushing operation may also be determined only by whether or not ink droplets are jetted at the first drive period.

Further, in the embodiment, only one kind of ink droplets is jetted from the nozzles 15. However, the present teaching is not limited to such aspect, but a plurality of kinds of ink droplets different in size may also be jetted from the nozzles 15. For example, in the examples 3a to 3d of a table 4, a gradation control is performed by selectively jetting one of three kinds of ink droplets different in ink amount (to be referred to as large droplets, medium droplets, and small droplets in descending order of ink amount, hereinbelow) from the nozzles 15 in the recording jetting-operation. At this time, the flushing operation is performed by jetting large droplets in the flushing periods. Here, a large droplet has the largest jetting amount among the three kinds of ink droplets jetted in the recording jetting-operation. Further, in the table 4, "large", "medium", and "small" show that large droplets, medium droplets, and small droplets are jetted, respectively.

TABLE 4

| | Flushing Period | | | | | Drive Period |
|---|---|---|---|---|---|---|
| | 1 | 2 | 3 | 4 | 5 | 1 |
| Example 3a | — | — | — | Large | Large | Large |
| Example 3b | — | — | Large | Large | Large | Medium |
| Example 3c | — | Large | Large | Large | Large | Small |
| Example 3d | Large | Large | Large | Large | Large | — |

Figure 5:
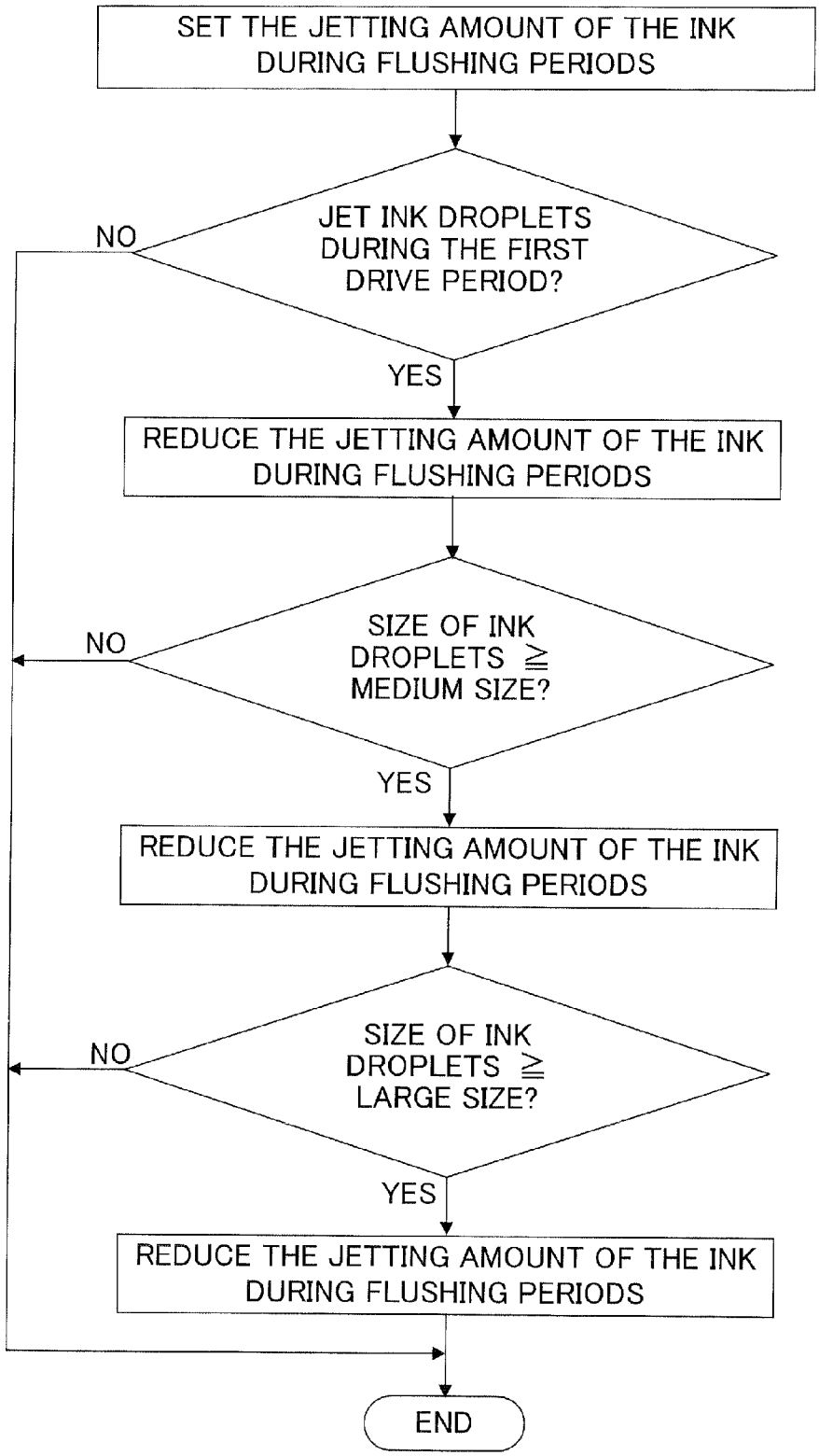
FIG. 5 is a flowchart for explaining the examples 3a to 3d of the present invention.

Then, in the same manner as the embodiment, the controller 20 controls the ink-jet head 3 so that when the ink droplets are jetted at the first drive period, the number of the flushing periods during which ink droplets are jetted (the total ink discharge amount in the flushing operation) becomes less in comparison with the case of not jetting ink droplets (see the flow chart as shown in FIG. 5).

Further, as shown in the flowchart of FIG. 5, the controller 20 controls the ink-jet head 3 so that when the small ink droplets are jetted at the first drive period, the ink discharge amount in the flushing operation reaches the maximum. Further, the controller 20 controls the ink-jet head 3 so that when the medium droplets are jetted, the ink discharge amount in the flushing operation becomes less in comparison with the case of jetting the small droplets. Further, the controller 20 controls the ink-jet head 3 so that when the large droplets are jetted, the ink discharge amount in the flushing operation becomes further less to reach the minimum in comparison with the case of jetting the medium droplets. That is, the controller 20 controls the ink-jet head 3 so that the total ink discharge amount in the flushing operation becomes less for the case of jetting ink droplets with a larger ink amount.

In the case of jetting ink droplets at the first drive period, when the ink amount of jetted ink droplets is larger, jetting the ink droplets makes a greater contribution to the maintenance on the nozzles 15. Therefore, by lessening the total ink discharge amount in the flushing operation for the case of a larger ink droplet jetting amount with respect to the ink droplets during the first drive period, it is possible to reliably perform the maintenance on the nozzles 15 while reducing the ink consumption.

Further, in this case, because the flushing operation is performed by jetting the same large droplets as those jetted in the recording jetting-operation, it is possible to cause the ink-jet head 3 to perform the flushing operation by the same operation as that performed in the recording jetting-operation. That is, in order to jet ink droplets from the nozzles 15, it is not necessary to perform a different control for the flushing operation from that for the recording jetting-operation, and thereby the control becomes simplified.

Further, in the examples 3a to 3d of the table 4, the ink discharge amount in the flushing operation is changed only by the jetting amount of ink droplets at the first drive period. However, the present teaching is not limited to this but, in the same manner as the embodiment, the ink discharge amount in the flushing operation may also be changed by the jetting aspect of ink droplets in the first successive multiple drive periods.

For example, in addition to the examples 3a to 3d of the table 4, further, in the case of jetting ink droplets at the first drive period, when the ink amount jetted at the first drive period (the jetting aspect of ink droplets at the first drive period) is the same, then the total ink discharge amount in the flushing operation can be lessened for the case of a larger total amount of ink droplets jetted during the first three successive drive periods. Further, when the ink droplets are not jetted at the first drive period, the total ink discharge amount in the flushing operation can be lessened for the case of a larger total amount of ink droplets jetted during two successive drive periods.

However, in this case, the three kinds of ink droplets that are different in ink amount are selectively jetted from the nozzles 15 in the recording jetting-operation. In contrast with the case of the examples 1a to 1d of the table 1 as described hereinbefore, the total amount of ink droplets jetted during the above three drive periods is indivisible by the ink amount of large droplets. Therefore, there is a fear that the ink amount of summing up the total ink discharge amount in the flushing operation and the total amount of ink droplets jetted during the above three drive periods cannot become equal to the maximum flushing amount.

For example, only if possible, the controller 20 controls the ink-jet head 3 to perform the flushing operation so that the ink amount of summing up the total ink discharge amount in the flushing operation and the total amount of ink droplets jetted during the above three drive periods becomes equal to the maximum flushing amount. On the other hand, if that is not possible, the controller 20 controls the ink-jet head 3 to perform the flushing operation so that the ink amount of summing up the total ink discharge amount in the flushing operation and the total amount of ink droplets jetted during the above three drive periods becomes larger than the maximum flushing amount, and that the number of the jet periods during which ink droplets are jetted (the total ink discharge amount in the flushing operation) reaches the minimum among the above five flushing periods.

That is, the controller 20 controls the ink-jet head 3 to perform the flushing operation so that the ink amount of summing up the total ink discharge amount in the flushing operation and the total amount of ink droplets jetted during the above three drive periods becomes equal to or more than the maximum flushing amount, and that the total ink discharge amount in the flushing operation becomes the minimum.

In contrast with the case of the examples 3a to 3d of the table 4, the controller 20 may also control the ink-jet head 3 to selectively jet one of the three kinds of ink droplets in the recording jetting-operation to perform the flushing operation. At the time, the controller 20 may control the ink-jet head 3 to perform the flushing operation so that the ink amount of summing up the total ink discharge amount in the flushing operation and the total amount of ink droplets jetted during the above three drive periods becomes equal to the maximum flushing amount by changing the kind of ink droplets jetted in the flushing operation according to the total ink amount of ink droplets jetted during the above three drive periods.

Even in these cases, the ink amount of summing up the total ink discharge amount in the flushing operation and the total amount of ink droplets jetted during the above three drive periods becomes equal to or more than the maximum flushing amount. Regardless of the jetting aspects of ink droplets during the above three drive periods, it is possible to jet ink with the maximum flushing amount before the above three drive periods elapse, and at the same time, it is also possible to restrain the ink consumption in the flushing operation to the minimum.

Further, in the above cases, the controller 20 controls the ink-jet head 3 to perform the flushing operation so that just after the above three drive periods, the ink amount of summing up the total ink discharge amount in the flushing operation and the total amount of ink droplets jetted during the above three drive periods becomes equal to or more than the maximum flushing amount, and that the total ink discharge amount in the flushing operation becomes the minimum. However, the present teaching is not limited to such aspect. When the ink amount of summing up the total ink discharge amount in the flushing operation and the total amount of ink droplets jetted during the above three drive periods is equal to or more than the maximum flushing amount, the total ink discharge amount in the flushing operation may as well not reach the minimum.

Further, in the embodiment described hereinbefore, the controller 20 controls the ink-jet head 3 so that the total ink discharge amount in the flushing operation becomes less for a case of a shorter time interval in which ink droplets are not jetted, when the flushing operation is performed between two recording jetting-operations, and when the ink droplets are not jetted at the last drive period in the preceding recording jetting-operation. However, the present teaching is not limited to such aspect. For example, the controller 20 may also control the ink-jet head 3 so that in the flushing operation, the ink is discharged with a certain amount more than that in the case of jetting ink droplets at the last drive period in the preceding recording jetting-operation, regardless of the time interval in which ink droplets are not jetted, when the ink droplets are not jetted at the last drive period in the preceding recording jetting-operation.

Further, in the above cases, the controller 20 controls the ink-jet head 3 so that the total ink discharge amount in the flushing operation becomes less for a case of a larger total amount of ink droplets jetted during the first three successive drive periods in the recording jetting-operation. However, the present teaching is not limited to such aspect. For example, the controller 20 may also control the ink-jet head 3 so that the total ink discharge amount in the flushing operation becomes less for a case of a larger total amount of ink droplets jetted during the first two successive drive periods, or the first four or more successive drive periods. Further, in the above described embodiment, the flushing operation is performed with five or seven periods. However, the present teaching is not limited to this. That is, it is possible to change the maximum flushing amount according to the diameter and length of the nozzles 15, the viscosity and water amount of the ink, or the environmental temperature, and thus it is possible to select the number of periods of the flushing operation in accordance with those conditions. Then, according to the number of periods of the flushing operation, it is possible to appropriately change the number of the first successive drive periods in the recoding jetting operation.

Further, in the above cases, the flushing operation is performed by jetting the same ink droplets from the nozzles 15 as those jetted in the recording jetting-operation. However, the present teaching is not limited to this. For example, the flushing operation may also be performed by jetting ink droplets different in ink amount from those jetted in the recording jetting-operation such as ink droplets with an even larger ink amount than that of those jetted in the recording jetting-operation. Further, the present teaching may also be applied to a color printer such as a color printer configured to jet four colors of inks including cyan, magenta, yellow and black. The flushing operation can be changed or adjusted based on the colors of the inks. For example, an amount of the yellow ink jetted during the flushing operation can be reduced in comparison with an amount of the other inks jetted during the flushing operation, because the yellow ink is a less obtrusive color and the printing result by using the yellow ink is not highly visible.

Further, in the above cases, the flushing operation is performed by jetting ink droplets toward the foam for waste liquid 5. However, the present teaching is not limited to this. The flushing operation may also be performed by jetting ink droplets toward an inconspicuous area in the recording on the recording paper P.

Further, in the above cases, the explanations are made with respect to the examples in which the present invention is applied to a printer provided with a so-called serial ink jet head performing printing on the recording paper P by jetting ink droplets from nozzles while moving reciprocatingly in a scanning direction. However, the present teaching is not limited to this and, for example, it is also possible to apply the present invention to a printer provided with a so-called line head extending over the entire length of the recording paper P in the width direction thereof and jetting ink droplets without moving.

Further, in the above cases, the explanations are made with respect to the examples in which the present invention is applied to a printer provided with an ink-jet head jetting ink droplets from nozzles. However, it is also possible to apply the present invention to any liquid droplet jetting apparatuses provided with a head jetting droplets of any liquid other than ink, provided that the liquid droplet jetting apparatus performs an operation to maintain the nozzles.

What is claimed is:

1. A recording apparatus which jets droplets of a liquid onto a recording medium, comprising:

a head which jets the liquid droplets and in which a plurality of nozzles are formed; and a controller which controls the head to perform:

a recording jetting-operation in which the liquid droplets are jetted toward the recording medium from the nozzles at a plurality of drive periods, respectively, based on input data input to the recording apparatus; and a flushing operation in which a maintenance on the nozzles is performed by jetting the liquid droplets from the nozzles prior to the recording jetting-operation;

wherein the controller:

judges, based on the input data, whether or not the head jets a liquid droplet from each of the nozzles at a first drive period of the drive periods in the recording jetting-operation; and controls the head so that a total liquid discharge amount in each of the nozzles in the flushing operation becomes less in a case of jetting a liquid droplet at the first drive period, in comparison with a case of not jetting the liquid droplet at the first drive period;

wherein the controller controls the head so that the total liquid discharge amount in each of the nozzles in the flushing operation becomes less for a case of a larger total amount of the liquid droplets jetted during a plurality of predetermined successive drive periods including the first drive period, through which a same volume of liquid droplet is jetted at the first drive period; and wherein the controller controls the head to perform the flushing operation so that a total sum amount in each of the nozzles, which is defined by summing up the total liquid discharge amount in the flushing operation and the total amount of the liquid droplets jetted during the successive drive periods in the recording jetting-operation, becomes not less than a maximum liquid amount that is maximally-dischargeable in the flushing operation and that the total liquid discharge amount in the flushing operation becomes a minimum.

2. The recording apparatus according to claim 1:

wherein the liquid droplets include a plurality of kinds of liquid droplets of which volumes are different from each other;

wherein the controller controls the head so that the plurality of kinds of liquid droplets are jetted from the nozzles at one of the drive periods in the recording jetting-operation; and wherein the controller controls the head so that the total liquid discharge amount in each of the nozzles in the flushing operation becomes less for a case of jetting a liquid droplet with a larger liquid amount at the first drive period in the recording jetting-operation.

3. The recording apparatus according to claim 2;

wherein the controller controls the head to perform the flushing operation so that liquid droplets having a maximum liquid amount among the plurality of kinds of the liquid droplets jetted in the recording jetting-operation are jetted in the flushing operation.

4. A recording apparatus which jets droplets of a liquid onto a recording medium, comprising:

a head which jets the liquid droplets and in which a plurality of nozzles are formed; and a controller which controls the head to perform:

a recording jetting-operation in which the liquid droplets are jetted toward the recording medium from the nozzles at a plurality of drive periods, respectively, based on input data input to the recording apparatus; and a flushing operation in which a maintenance on the nozzles is performed by jetting the liquid droplets from the nozzles prior to the recording jetting-operation;

wherein the controller:

judges, based on the input data, whether or not the head jets a liquid droplet from each of the nozzles at a first drive period of the drive periods in the recording jetting-operation; and controls the head so that a total liquid discharge amount in each of the nozzles in the flushing operation becomes less in a case of jetting a liquid droplet at the first drive period, in comparison with a case of not jetting the liquid droplet at the first drive period;

wherein the controller controls the head to perform the recording jetting-operation twice;

wherein the controller controls the head to perform the flushing operation between a preceding recording jetting-operation and a succeeding recording jetting-operation of the two recording jetting-operations; and wherein the controller controls the head so that the total liquid discharge amount in each of the nozzles in the flushing operation becomes less for a case of jetting a liquid droplet at a last drive period in the preceding recording jetting-operation in comparison with the case of not jetting the liquid droplet at the last drive period.

5. The recording apparatus according to claim 4;

wherein the controller controls the head so that the total liquid discharge amount in each of the nozzles in the flushing operation becomes less for a case of a shorter time interval in which the liquid droplets are not jetted, under a condition that a liquid droplet is not jetted at the last drive period in the preceding recording jetting-operation.

6. The recording apparatus according to claim 4;

wherein the liquid droplets include a plurality of kinds of liquid droplets of which volumes are different from each other;

wherein the controller controls the head so that the plurality of kinds of liquid droplets are jetted from the nozzles at one of the drive periods in the recording jetting-operation; and wherein the controller controls the head so that the total liquid discharge amount in each of the nozzles in the flushing operation becomes less for a case of getting a liquid droplet with a larger liquid amount at the first drive period in the recording jetting-operation.

7. The recording apparatus according to claim 6;

wherein the controller controls the head to perform the flushing operation so that liquid droplets having a maximum liquid amount among the plurality of kinds of the liquid droplets jetted in the recording jetting-operation are jetted in the flushing operation.

* * * * *